US006570601B2

(12) United States Patent
Jimbo

(10) Patent No.: US 6,570,601 B2
(45) Date of Patent: May 27, 2003

(54) METHOD OF DRIVING A THERMAL LINE PRINTER AND THERMAL LINE PRINTER

(75) Inventor: Seiichi Jimbo, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 10/001,334

(22) Filed: Oct. 26, 2001

(65) Prior Publication Data

US 2002/0113857 A1 Aug. 22, 2002

(30) Foreign Application Priority Data

Oct. 31, 2000 (JP) ..... 2000-333370

(51) Int. Cl.[7] ..... B41J 2/35; B41J 2/355
(52) U.S. Cl. ..... 347/182; 347/180; 347/181
(58) Field of Search ..... 347/211, 180, 347/181, 182; 400/120.05, 123.06

(56) References Cited

U.S. PATENT DOCUMENTS 4,731,618 A * 3/1988 Shimazaki ..... 347/181
4,745,413 A * 5/1988 Brownstein et al. ..... 347/211
5,412,406 A * 5/1995 Fujimoto ..... 348/180

FOREIGN PATENT DOCUMENTS

JP 5-201052 * 8/1993 ..... 347/182
JP 5-201053 * 8/1993 ..... 347/182
JP 5-336325 * 12/1993 ..... B41J/02/355
JP 2001-191573 * 7/2001 ..... B41J/02/355

* cited by examiner

*Primary Examiner*—Huan Tran
(74) *Attorney, Agent, or Firm*—Adams & Wilks

(57) ABSTRACT

A thermal line printer drive method and a thermal line printer devised to prevent occurrence of a white gap during printing. A plurality of heating elements arranged on a line perpendicular to a sheet feed direction are separated into a plurality of blocks, and the heating elements in each block are driven separately from those in other blocks to perform thermal recording on a heat-sensitive sheet. A drive pulse is applied to each heating element in each block a certain number of times by being divided.

14 Claims, 9 Drawing Sheets

METHOD OF DRIVING A THERMAL LINE PRINTER AND THERMAL LINE PRINTER

BACKGROUND OF THE INVENTION

1. Field of the Invention

The present invention relates to a method of driving a thermal line printer which performs thermal recording with a thermal line head, and to a thermal printer.

2. Description of the Related Art

Thermal line printers are known which perform thermal recording of images, characters, etc., on a heat-sensitive sheet of a predetermined size by using a thermal line head having a plurality of heating resistors arranged in a row. Ordinarily, in printers of this kind, the thermal line head is driven and controlled by being divided into blocks according to a driving method related to a semiconductor integrated circuit (IC) for driving the head.

That is, as shown in the block diagram of FIG. 2, a thermal line head 3 has, for example, 384 (64 dots×6 blocks) heating resistors R arranged in a lateral row, a shift register 30 which holds serially-input print dot data corresponding to one line, a latch register 20 which holds groups of one-line print dot data items supplied parallel with each other from the shift register 30, a selection circuit 10 formed of NAND circuits for selectively driving the heating resistors R in the printing blocks according to the print dot data from the latch register 20 while being timed on the basis of strobe signals STB1 to STB6 from a central processing unit (CPU) of a drive controller, a thermistor for detecting the temperature of a head portion, etc. Currents are caused to flow through the heating resistors R selected from the 384 heating resistors R according to the printing data to perform desired line-by-line pattern printing on a heat-sensitive sheet. Strobe signals STB1 to STB6 are signals for determining ON/OFF conditions of the heating resistors R.

When the amount of printing data (the number of dots to be printed) is large, considerably large power is consumed for energization of the heating resistors R if all the heating resistors to be driven are simultaneously energized. In such a case, a large and high-cost power supply unit is required. A method has therefore been practiced in which the heating resistors R for printing one line are not simultaneously energized but partially energized with respect to each of a plurality of printing blocks (e.g., six blocks 1 to 6) into which the heating resistors R are separated.

More specifically, drive pulses phase-shifted as shown in FIG. 8, for example, are ordinarily applied for energization. That is, drive pulse P10 is applied block 1, drive pulse P11 to block 2, drive pulse P12 to block 3, drive pulse P13 to block 4, drive pulse P14 to block 5, and drive pulse P15 to block 6, each pulse being phase-shifted from the preceding one by the amount corresponding to the one-pulse width.

After the completion of printing of one line in the above-described manner, the heat-sensitive sheet is fed one step in intermittent feeding, and printing of the next line is subsequently performed, thus performing printing on the entire surface of the heat-sensitive sheet.

However, it has been found that in a case where printing is performed by applying drive pulses P10 to P15 to the resistors R in printing blocks 1 to 6 while shifting the phase of each pulse by the amount corresponding to the pulse width as described above, a problem arises that a white gap line W is generated between the blocks 1 to 6, as shown in FIG. 9. FIG. 9 shows the result of solid-tone printing through one line in such a manner as to emphasize generation of white gap W.

A study made to find the cause of occurrence of such a white gap W has revealed that a nonuniform temperature distribution occurs in each of printing blocks 1 to 6 such that the temperature is higher at a center and is lower at the opposite ends, and the heat-sensitive sheet is not sufficiently heated at each block boundary. FIG. 10 is a graph showing temperature rising conditions of the heating resistors. A curve A represents the rise in temperature of one adjacent pair of the heating resistors at the center of one printing block when the heating resistors are simultaneously driven, and a curve B represents the rise in temperature of the adjacent pair of heating resistors at the adjacent ends of two printing blocks when the heating resistors are driven not simultaneously with each other.

As can be understood from this graph, a temperature difference T is caused between the center A and the end B of the printing blocks. It is thought that this temperature difference T is the cause of occurrence of white gap W at the ends of each adjacent pair of blocks, at which the temperature in the temperature distribution is lower. That is, in the case where thermal line head 3 arranged as shown in FIG. 3 is divided into six blocks 1 to 6 to separately print six groups of dots each consisting of 64 dots in 384 dots for one line, each of the pairs of the heating resistors corresponding to 64th and 65th dots, 128th and 129th dots, 192nd and 193rd dots, 256th and 257th dots, and 320th and 321st dots are not simultaneously driven. Therefore, heat applied to form these dots escapes to the adjacent-dot side, so that the amount of heat applied is insufficient for color development on the heat-sensitive sheet, resulting in occurrence of white gap W.

SUMMARY OF THE INVENTION

In view of the above-described problem, an object of the present invention is to provide a thermal line printer drive method which prevents occurrence of a white gap during printing, and a thermal line printer capable of preventing occurrence of the white gap.

To achieve this object, according to one aspect of the present invention, there is provided a method of driving a thermal line printer in which a plurality of heating elements (thermal line head 3, heating resistors R) arranged on a line perpendicular to a sheet feed direction are separated into a plurality of blocks (blocks 1 to 6), and in which the heating elements in each block are driven separately from those in other blocks to perform thermal recording on a heat-sensitive sheet, the method comprising applying a drive pulse (P1 to P6) to each heating element in each block a certain number of times by dividing the drive pulse and applying the divided pulses with a time shift.

This method enables the temperatures of the heating elements to be made generally uniform even though some adjacent pairs of the heating elements are not simultaneously driven, thereby preventing occurrence of the white gap, i.e., failure to develop the color on the heat-sensitive sheet at certain positions. Moreover, applying the drive pulse a certain number of times is effective in increasing the temperature of each heating element to a level high enough to sufficiently develop the color on the heat-sensitive sheet.

Preferably, the method also includes a comparison step of comparing the number of dots to be printed in one line and the largest number of energization dots for one line, and a printing method selecting step of selecting, on the basis of the result of comparison made in the comparison step, one of a division printing method of applying a drive pulse to each heating element in each block a certain number of times by dividing the drive pulse and a batch printing method of simultaneously applying drive pulses to the heating elements in the blocks. The largest number of energization dots is the largest number of heating resistor elements simultaneously energized, which number is selected to set an upper limit of power consumption.

For example, in the printing method selection step, the division printing method is selected when the number of dots to be printed in one line is comparatively large, while the batch printing method for high-speed printing is selected when the number of dots to be printed in one line is comparatively small. Thus, the optimum printing method can be selected according to printing conditions.

The drive pulse in the division printing method may be applied by being divided into drive pulses having a predetermined minimum pulse width determined by a current and a resistance value to make the temperatures of the heating elements generally uniform.

Further, groups of the blocks to which drive pulses are applied during the same time period may be determined according to the number of dots to be printed in one line. The efficiency with which the drive pulses are applied to the heating elements can be improved thereby.

Also, groups of pulses may be successively applied to the blocks in one group with a phase shift between the blocks. This is effective in making the temperatures of the heating elements in one group generally uniform.

According to another aspect of the present invention, there is provided a thermal line printer in which a plurality of heating elements arranged on a line perpendicular to a sheet feed direction are separated into a plurality of blocks, and in which the heating elements in each block are driven separately from those in other blocks under the control of drive control means to perform thermal recording on a heat-sensitive sheet, the printer comprising time division application means for applying a drive pulse to each heating element in each block a certain number of times by dividing the drive pulse.

This arrangement enables the temperatures of the heating elements to be made generally uniform even though some adjacent pairs of the heating elements are not simultaneously driven, thereby preventing occurrence of a white gap, i.e., failure to develop the color on the heat-sensitive sheet at certain positions. Moreover, applying the drive pulse a certain number of times is effective in increasing the temperature of each heating element to a level high enough to sufficiently develop the color on the heat-sensitive sheet.

According to still another aspect of the present invention, there is provided a thermal line printer in which a plurality of heating elements arranged on a line perpendicular to a sheet feed direction are separated into a plurality of blocks, and in which the heating elements in each block are driven separately from those in other blocks under the control of drive control means to perform thermal recording on a heat-sensitive sheet, the printer comprising shift application means for separating the heating elements into a plurality of blocks and for applying drive pulses by phase shifting the pulses with respect to the heating elements in different blocks in one group. This arrangement is effective in making the temperatures of the heating elements generally uniform.

According to a further aspect of the present invention, there is provided a thermal line printer in which a plurality of heating elements arranged on a line perpendicular to a sheet feed direction are separated into a plurality of blocks, and in which the heating elements in each block are driven separately from those in other blocks under the control of drive control means to perform thermal recording on a heat-sensitive sheet, the drive control means including comparison means for comparing the number of dots to be printed in one line and the largest number of energization dots for one line, printing method selecting means for selecting, on the basis of the result of comparison made by the comparison means, one of a division printing method of separating the heating elements into a plurality of groups and for applying drive pulses to the heating elements and a batch printing method of simultaneously applying drive pulses to the heating elements in the blocks, and time division application means for applying each pulse a certain number of times by dividing the pulse in the case where drive pulses are applied by the division printing method. In this arrangement, the division printing method can be selected when the number of dots to be printed in one line is comparatively large, and the batch printing method for high-speed printing can be selected when the number of dots to be printed in one line is comparatively small. Thus, the optimum printing method can be selected according to printing conditions.

The drive control means may also include number-of-blocks determination means for determining the number of blocks into which the heating elements are separated according to the number of dots to be printed in one line. The efficiency with which the drive pulses are applied to the heating elements can be improved thereby.

DESCRIPTION OF THE PREFERRED EMBODIMENT

A preferred embodiment of the present invention will be described with reference to FIGS. 1 through 7.

Figure 1:
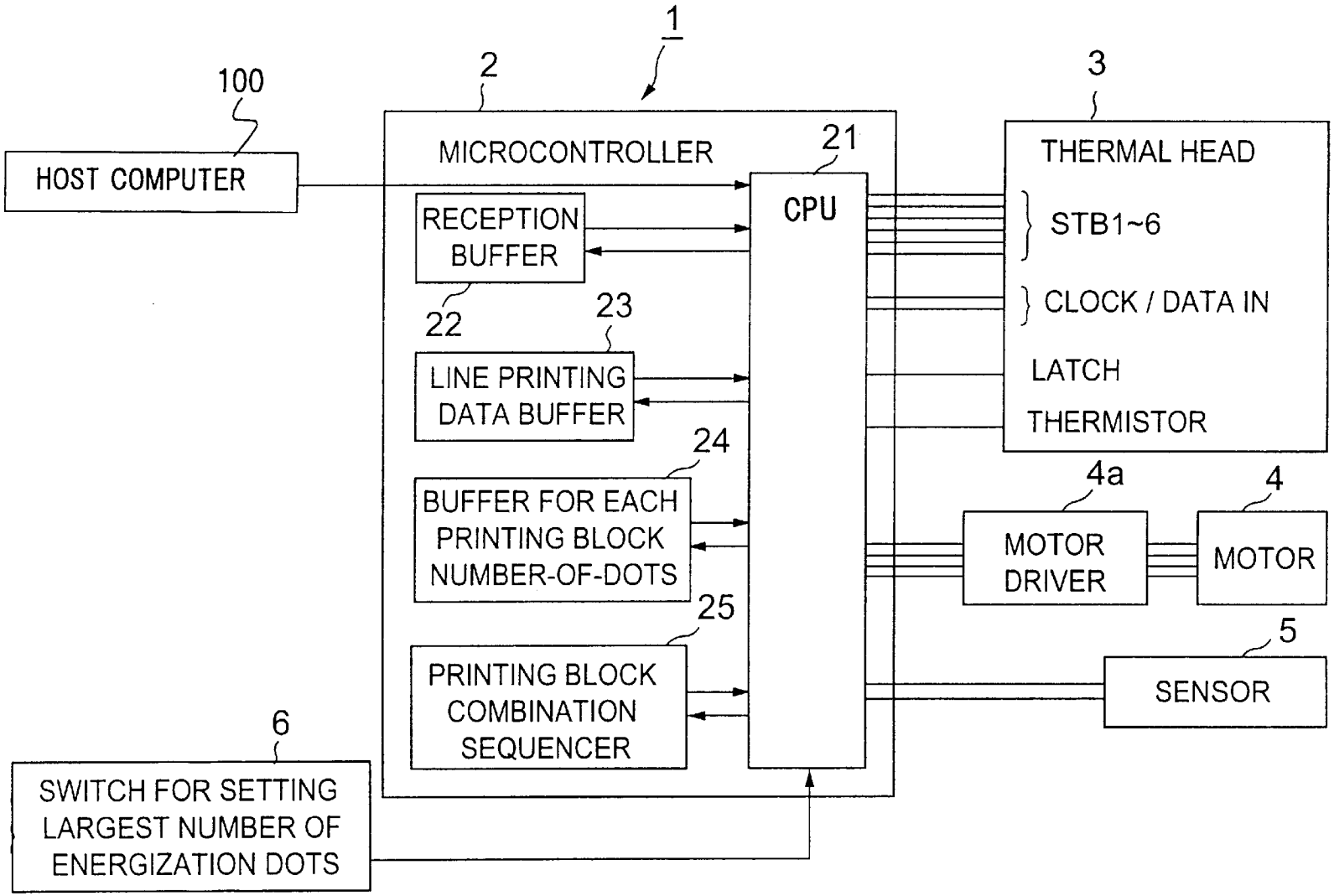
FIG. 1 is a block diagram showing the entire configuration of a thermal line printer which represents a preferred embodiment of the present invention.

FIG. 1 is a block diagram showing the entire configuration of a thermal line printer which represents a preferred embodiment of the present invention.

The thermal line printer 1 of this embodiment performs printing in such a manner that, while a heat-sensitive sheet is fed in an intermittent manner, heating resistors of a thermal line head 3 are energized according to printing data supplied from, for example, a host computer 100 existing outside the printer to generate heat for thermal development on the heat-sensitive sheet. This thermal line printer 1 is constituted by a microcontroller 2 for overall control of the printer, the thermal line head 3 which performs [perform] dot printing by causing thermal development of each of the dots on a heat-sensitive sheet provided as a printing sheet, a sensor 5 for determination as to, for example, the existence/nonexistence of a heat-sensitive sheet and whether the thermal line head 3 is in an operating position, and a DIP switch 6 for setting the largest number of energization dots.

The largest number of energization dots set by the DIP switch 6 is the largest number of heating resistor elements simultaneously energized, which number is selected to set an upper limit of power consumption.

The microcontroller 2 has a central processing unit (CPU) 21 for performing various kinds of computation processing and processing for controlling the printer 1, a reception buffer 22 for temporarily storing printing data supplied from the host computer 100, a line printing data buffer 23 for storing printing data corresponding to one line, and a number-of-dots buffer 24 for storing data on the number of dots to be printed by each of the printing blocks.

A sequencer (also referred to as "programmable logic controller (PLC)") constituted by computation processing routines determines a combination of strobe signals STB output from the CPU 2 on the basis of the contents in the buffer 24 for storing the number of printing block dots and the setting of the DIP switch 6. Lines for supplying strobe signals STB are connected directly to ports of the CPU 2. The CPU 2 outputs a combination of strobe signals STB determined by the sequencer 25.

The CPU 21 forms a control means for controlling energization of the heating resistors of the thermal line head 3 and controlling the amount by which the sheet feed stepping motor 4 is driven. Further, in this embodiment, the CPU 21 forms a comparison means for comparing the number of dots to be printed in one line and the largest number of energization dots for one line, a printing method selection means for selecting one of a division printing method and a batch printing method according to the result of comparison made by the comparison means, a decision means for making a decision relating to the number of heating resistors to be energized in one group of printing blocks, a division determination means for determining the number of drive divisions when the division printing method is selected, and a simultaneous drive means for simultaneously driving one group of printing blocks when the batch printing member is selected. Each of the division printing method and the batch printing method will be explained below.

Figure 2:
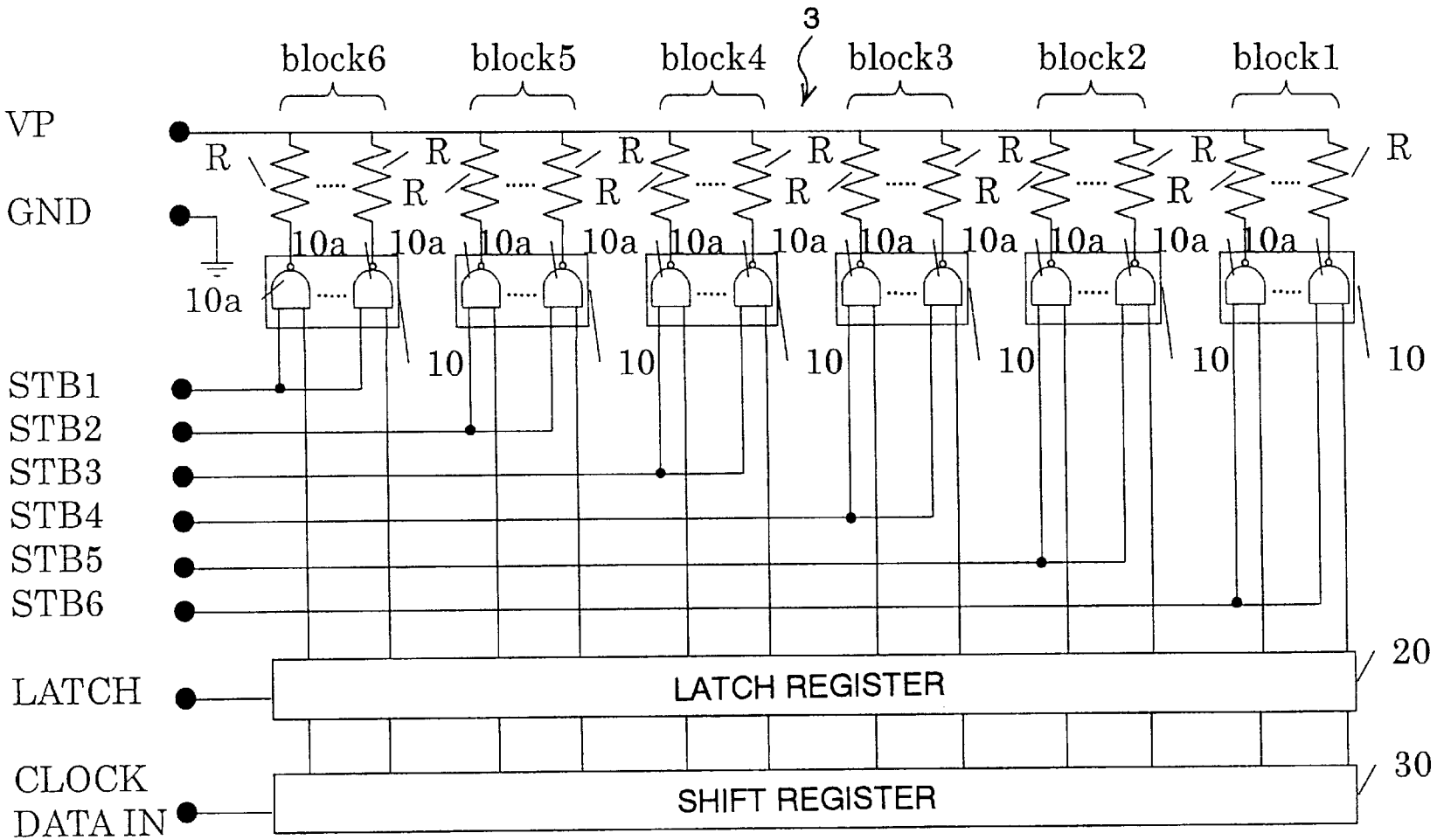
FIG. 2 is a diagram showing details of the thermal line head of the thermal line printer representing the embodiment.

FIG. 2 is a diagram showing details of the above-described thermal line head 3.

The thermal line head 3 of this embodiment has, for example, 384 (64 dots×6 blocks) heating resistors R arranged in a lateral row, a shift register 30 which holds serially-input print dot data corresponding to one line, a latch register 20 which holds groups of one-line print dot data items supplied parallel with each other from the shift register 30, a selection circuit 10 formed of NAND circuits for selectively driving the heating resistors R in the printing blocks according to the print dot data from the latch register 20 while being timed on the basis of strobe signals STB1 to STB6 from the CPU 21, a thermistor (not shown) for detecting the temperature of a head portion, etc. Currents are caused to flow through the heating resistors R selected from the 384 heating resistors R according to the printing data to perform desired line-by-line pattern printing on a heat-sensitive sheet. The heating resistors R are separated into, for example, six printing blocks 1 to 6.

Energization of heating resistors R in the batch printing method and in the division printing method will be described.

If the result of determination made by the comparison means is that (the number of print dots in one line)≦(the largest number of energization dots), the selection means selects the batch printing method. In the batch printing method, the heating resistors R for printing one line are simultaneously energized in all the printing blocks to print one line at a time. Power consumption for this energization in the printer is not considerably large since the number of print dots in one line is comparatively small.

If the result of determination made by the comparison means is that (the number of print dots in one line)>(the largest number of energization dots), the selection means selects the division printing method. In the division printing method, each of a plurality of (e.g., six) printing blocks into which the heating resistors R for printing one line are separated is separately energized and drive power is applied a certain number of times by being divided. For instance, as shown in the time chart of FIG. 3, four drive pulses are applied to each block in one printing step by being phase shifted from those applied to the preceding block, drive pulses (strobe signal) P1 being applied to the block 1; drive pulses P2 to block 2; drive pulses P3 to block 3; drive pulses P4 to block 4; drive pulses P5 to block 5; and drive pulses P6 to block 6. Each of drive pulses P1 to P6 is formed by a pulse current having a duration of about 1 ms, for example. The above-described one-line printing is repeated while the heat-sensitive sheet is intermittently fed, thus performing printing on the entire surface of the heat-sensitive sheet.

Figure 7:
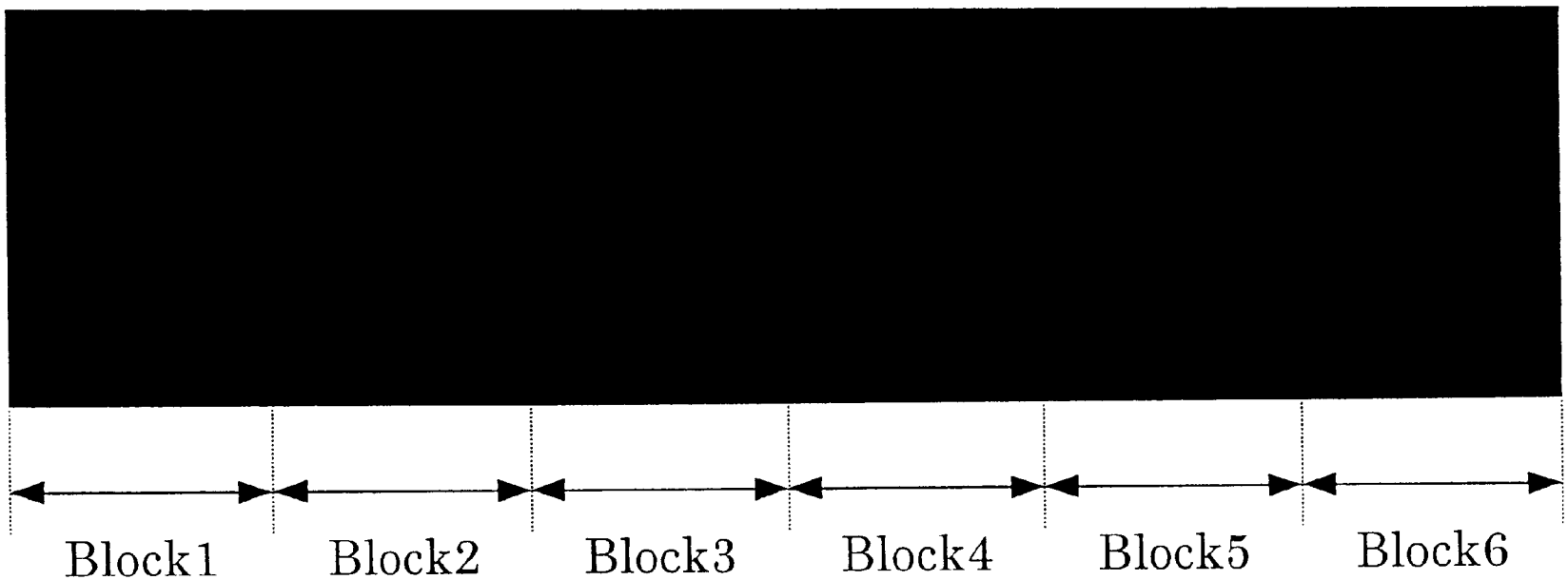
FIG. 7 is a diagram showing the result of printing (solid-tone printing) based on the division printing method for the thermal line printer of the present invention.
Figure 8:
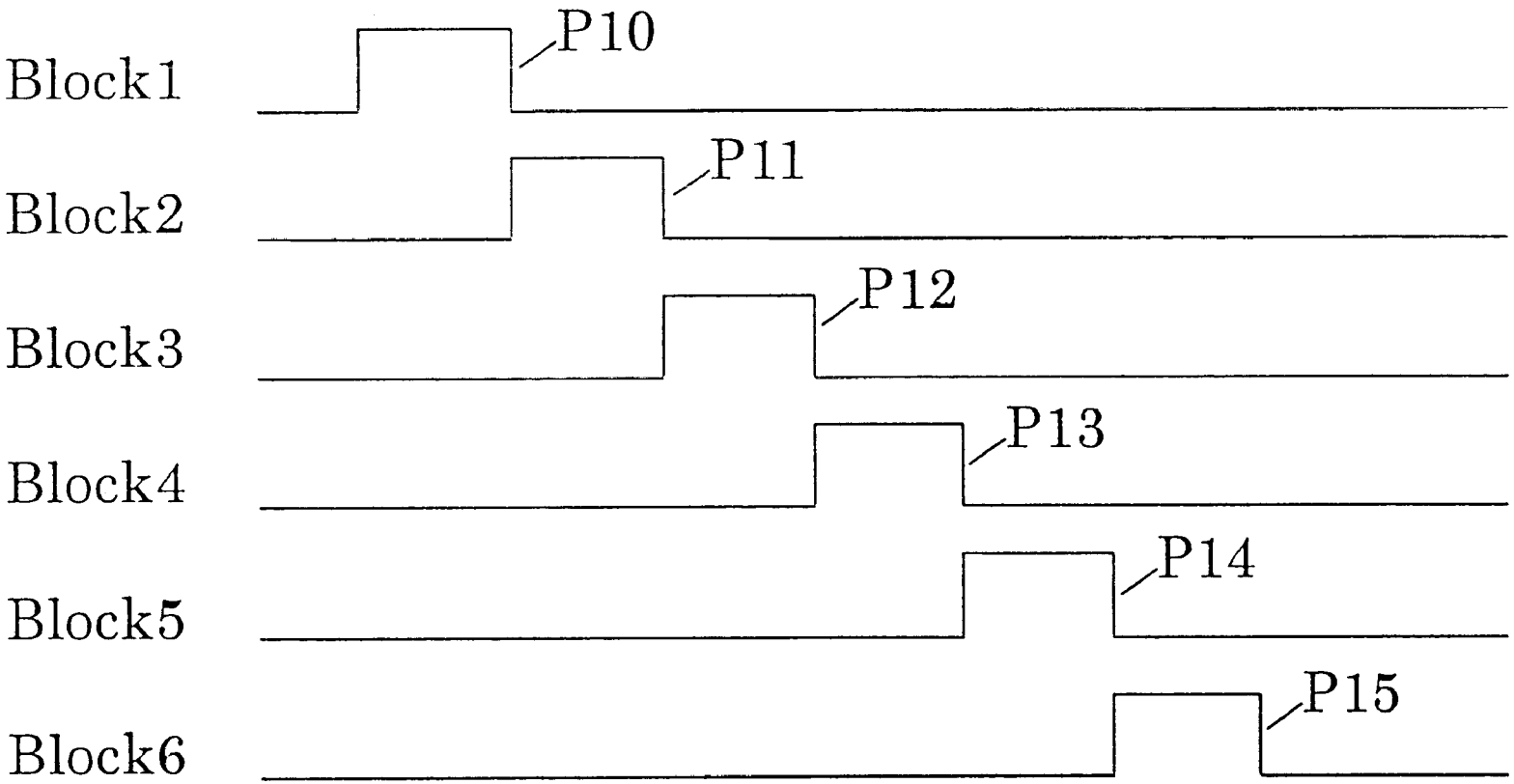
FIG. 8 is a time chart for explaining a division printing drive method for a conventional thermal line printer.
Figure 9:
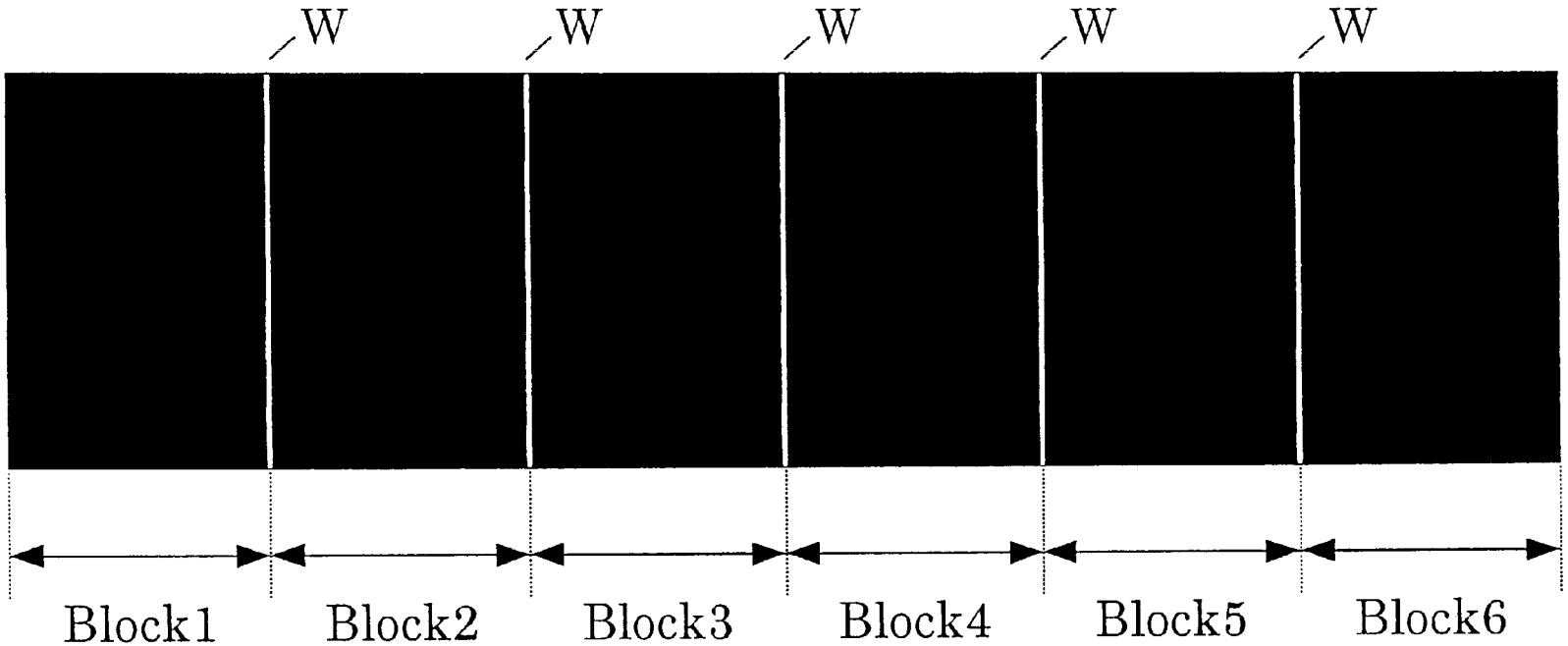
FIG. 9 is a diagram showing the result of printing (solid-tone printing) according to division printing in the conventional thermal line printer.
Figure 10:
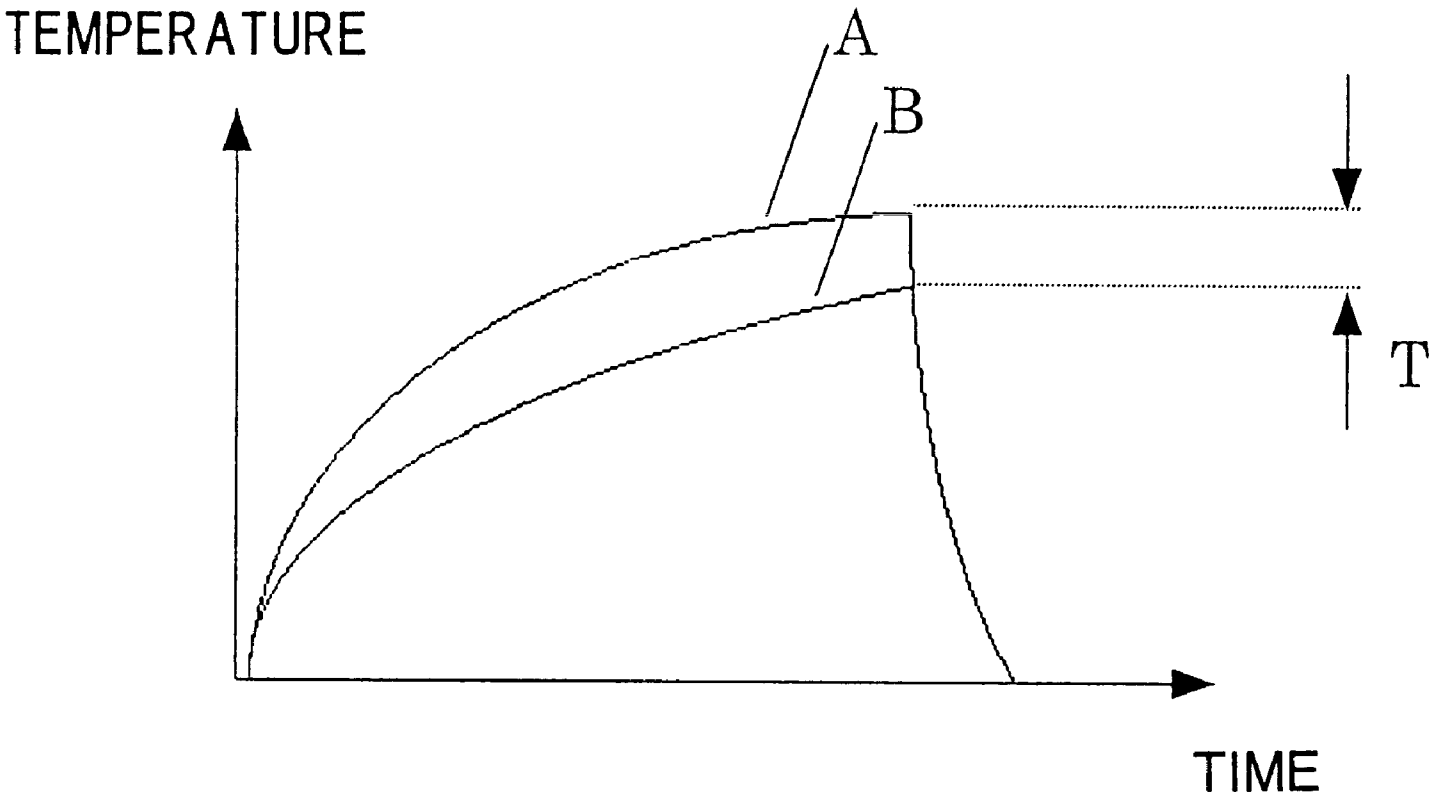
FIG. 10 is a graph showing temperature rising conditions of heating resistors.

This division printing method makes it possible to limit the maximum power consumption of the printer to a certain value even when the number of dot to be printed in one line is comparatively large. The method also makes it possible to cause the heating resistors R to generate heat generally uniformly in each printing block. Thus, although some adjacent pairs of heating resistors R are not simultaneously driven, the thermal head 3 can generate heat so that its temperature is generally uniform through its entire heating region and can therefore perform printing with improved uniformity (see FIG. 7) without generating a white gap W (see FIG. 9). FIG. 7 shows the result of solid-tone printing through one line performed to confirm the effect of preventing occurrence of the white gap.

The number of the printing blocks described above can be changed through setting of the DIP switch 6, processing of the sequencer 25 or the like. That is, when the thermal line printer 1 is initialized by arbitrarily setting the state of the DIP switch 6, the CPU 21 divides the heating resistors R into a predetermined number of groups (e.g., four to eight groups) such that the number of resistors R in one printing block does not exceed the largest number of energization dots designated by the DIP switch 6, each group being set as one printing block. Further, the sequencer 25 relates the printing blocks (block 1, block 2, . . . ) set as described above and strobe signals (STB1, STB2, . . . ) to each other, thereby completing the process of changing the printing block setting. Ordinarily, once the system specifications are determined, the number by which the heating resistors are divided is also determined and, therefore, the DIP switch is not changed during use.

A further description will be made by assuming that the heating resistors R are divided into six groups to form one printing block for printing of 64 dots.

The selection circuit 10 is also divided into six blocks, i.e., the same number as the number of printing blocks 1 to 6. Each block has 64 NAND circuits 10*a* in the same number as the number of dots printable by one block. To input terminals of each NAND circuit 10*a* are supplied one of strobe signals STB1 to STB6, which is set to be supplied from the CPU 21 to the corresponding block, and the corresponding signal of print dot data from the latch register 20. To an output terminal of each NAND circuit 10*a*, one end of one of the above-described heating resistors R is connected. The other end of the heating resistor R is connected to a common power supply terminal VP.

In printing based on the batch printing method or the division printing method is performed, when each of the strobe signal (one of signals STB1 to STB6) and print dot data signal is high level, a low-level voltage is output to the output side to energize the corresponding heating resistor R, thereby generating heat. That is, print dot data corresponding to one line is input to and stored in the latch register 20 and strobe signals set as desired are transmitted to perform dot printing through the printing block corresponding to the strobe signals.

Figure 3:
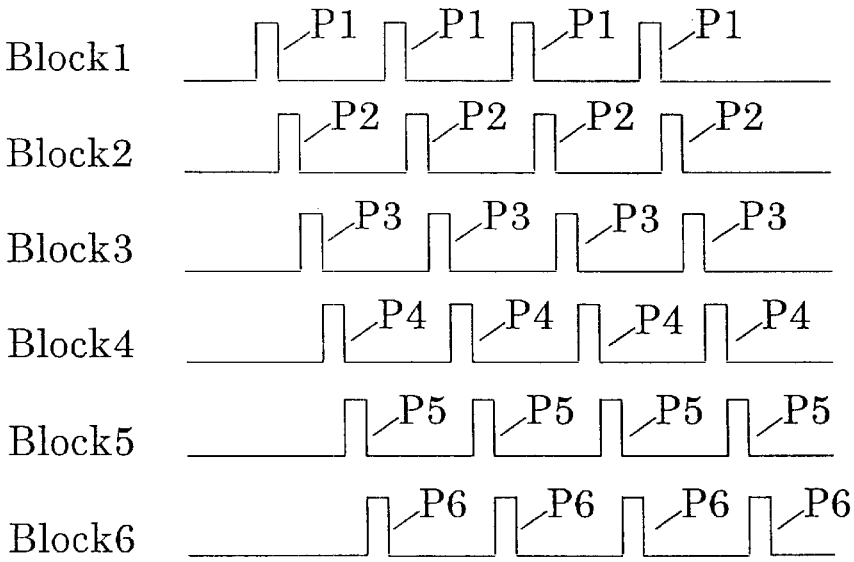
FIG. 3 is a time chart for explaining an example of a drive method based on a division printing method for the thermal line printer of the present invention.
Figure 4:
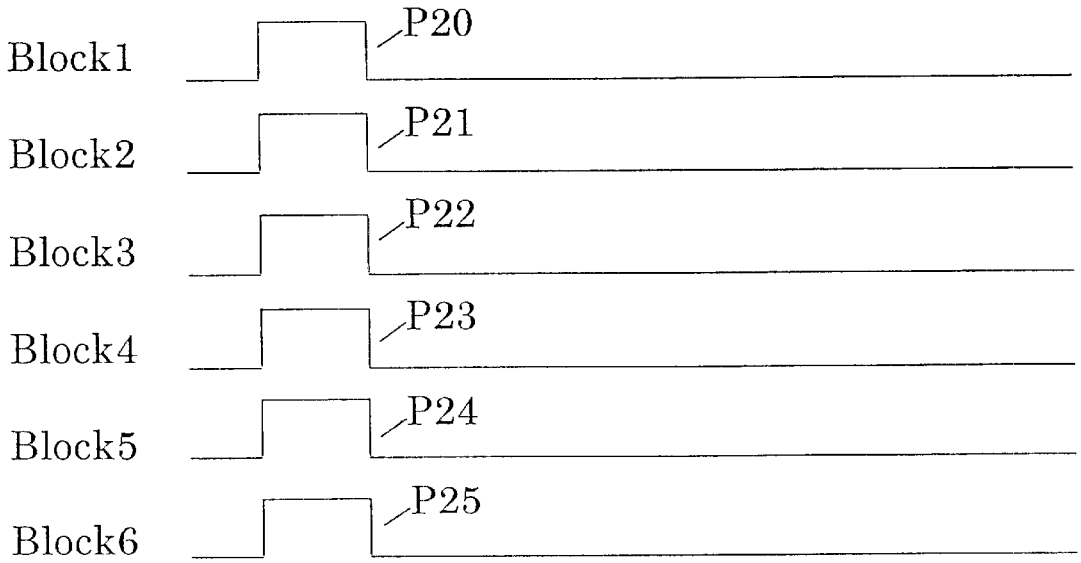
FIG. 4 is a time chart for explaining an example of a drive method based on a batch printing method for the thermal line printer of the present invention.

More specifically, when printing based on the batch printing method is performed, pulse signals P20 to P25 having a pulse width of, for example, about 4 ms and synchronized with each other are applied as strobe signals STB1 to STB6 to the printing blocks 1 to 6, as shown in FIG. 4, thereby printing one line at a time. When printing based on the division printing method is performed, pulse signal groups each consisting of four pulses having a pulse width of about 1 ms are applied as strobe signals STB1 to STB6 to the printing blocks 1 to 6 while being phase shifted one from another, as shown in FIG. 3, thereby performing one-line printing.

The procedure of printing processing will now be described with reference to the flowcharts of FIGS. 5 and 6.

Figure 5:
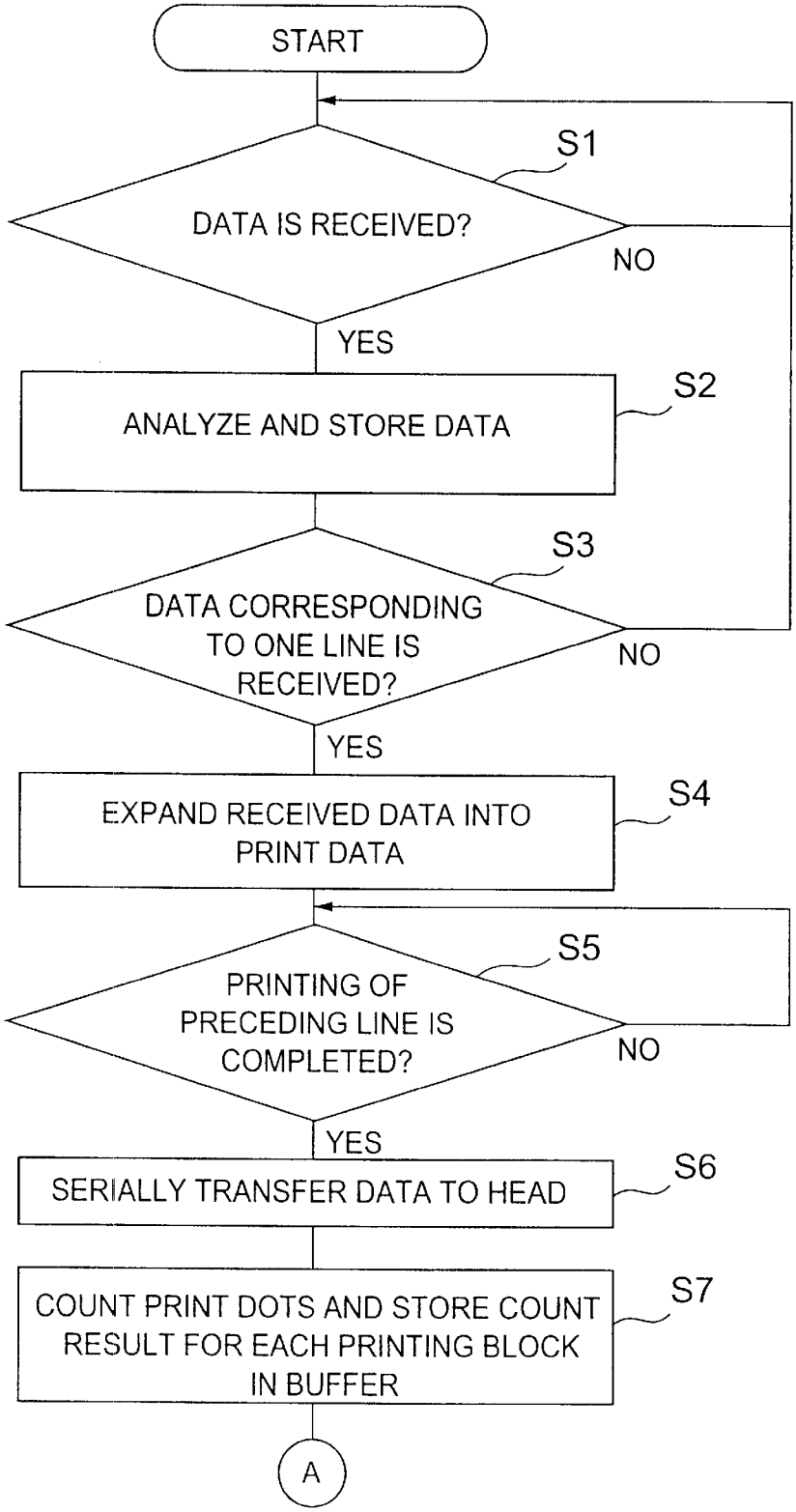
FIG. 5 is a flowchart (first half) of the procedure of a printing process performed under the control of the CPU 21 shown in FIG. 1.
Figure 6:
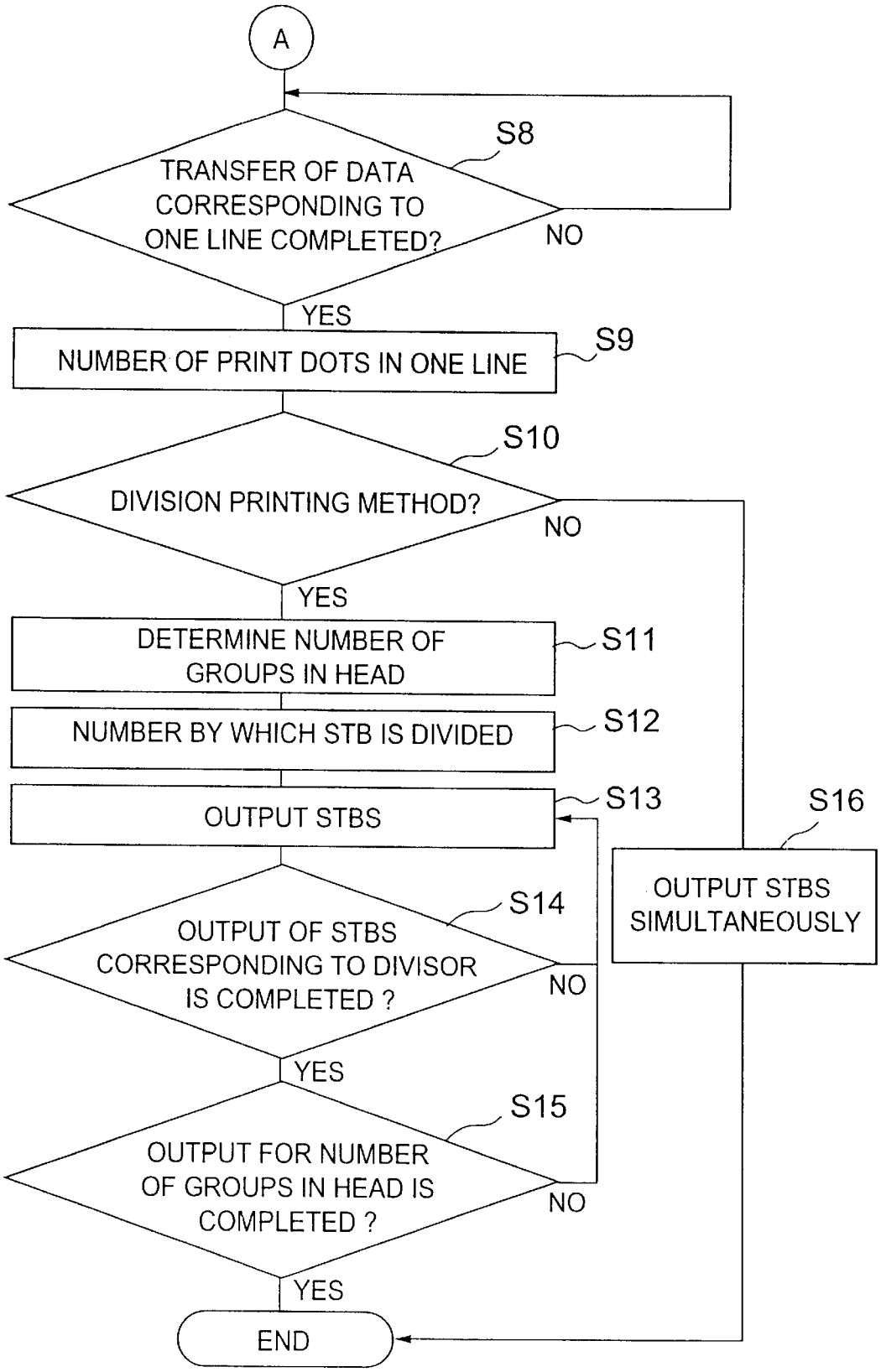
FIG. 6 is another flowchart (second half) of the procedure of the printing process performed under the control of the CPU 21 shown in FIG. 1.

FIGS. 5 and 6 are flowcharts of the procedure of a printing process performed under the control of the CPU 21 shown in FIG. 1.

This printing process is started by, for example, turning on the power or making a mode change into a printing mode by operating a mode switch. When this process is started, a determination is first made in step S1 as to whether print data from the outside, e.g., from the host computer has been received. If no print data has been received, this step is repeated until print data is received. If print data has been received, the process advances to step S2.

In step S2, the data format, etc., of the received print data are analyzed and the received data is stored in the reception buffer 22. The process then advances to step S3.

In step S3, a determination is made as to whether the amount of data stored in the reception buffer 22 has become equal to the amount corresponding to one line. If the amount corresponding to one line has not been reached, the process returns to step S1 and steps S1 to S3 are repeated until reception of data corresponding to one line is completed. If the amount corresponding to one line has been reached, the process advances to step S4.

In step S4, the received data corresponding to one line is expanded into print data representing a dot pattern in one line, and this print data is temporarily stored in the one-line pint data buffer 23. The process then advances to step S5.

In step S5, a determination is made as to whether printing of the preceding line is completed, that is, whether the shift register 30 of the thermal line head 3 is empty. If printing of the preceding line is not completed, the step S5 is repeated and the completion is awaited. If it is determined that printing of the preceding line is completed, the process advances to step S6.

In step S6, the print data corresponding to one line is serially transferred to the shift register 30 of the thermal line head 3, and the process advances to step S7. In step S7, the number of print dots to be printed by each of printing blocks 1 to 6 (the number of energization dots) is counted and the count result with respect to each printing block is stored in the number-of-dots buffer 24 (see FIG. 1). The process then advances to step S8.

In step S8, a determination is made as to whether the printing data corresponding to one line has been transferred. If it is determined that transfer of the data is not completed, step S8 is repeated until transfer of the data is completed. If it is determined that transfer of the data is completed, the process advances to the next step S9.

In step S9, determination data for determination as to whether the sum of the numbers of dots to be printed by all the printing blocks 1 to 6 (the sum of dots to be printed in one line) exceeds the largest number of energization dots is prepared on the basis of the number of dots to be printed by each printing block, which is counted in step S7. The process then advances to step S10.

In step S10, the determination data about all the printing blocks 1 to 6 and the largest number of energization dots are compared for determination as to whether the division printing method or the batch printing method will be selected. That is, if it is determined that "the number of dots to be printed in one line>the largest number of energization dots", the process advances to step S11 to select the division printing method. If it is determined that "the number of dots to be printed in one line≦the largest number of energization dots", the batch printing method is selected and the process advances to step S16, in which strobe signals STB1 to STB6 (drive pulses P20 to P25 shown in FIG. 4) are simultaneously output to all the printing blocks 1 to 6 to print one line at a time, thereby completing the printing process. For instance, in a case where the largest number of energization dots is 64, the division printing method is selected when the number of dots to be printed in one line is 65 or larger, and the batch printing method is selected when the number of dots to be printed in one line is 64 or smaller.

In step S11, the number of groups into which the blocks of the thermal line head 3 should be separated is determined to execute the division printing method. That is, a stroke signal STB drive plan is made by separating the printing blocks 1 to 6 into a predetermined number of groups according to the amount of print data such that the largest number of energization dots is not exceeded in one printing step. For instance, in a case where the numbers of dots to be printed are 22 dots by block 1, 64 dots by block 2, 64 dots by block 3, 32 dots by block 4, 64 dots by block 5, and 10 dots by block 6, the number of groups into which the blocks of the thermal line head 3 are separated is set to "4" and a grouping plan is made such that the blocks 1, 4, and 6 (for 64 dots) will be driven in the first printing step, the block 2 will be driven in the second printing step, the block 3 will be driven in the third printing step, and the block 5 will be drive in the fourth printing step.

The number of groups into which the blocks of the thermal line head 3 are separated can be changed between, for example, 2 and 6 according to the amount of print data.

In step S12, the time period during which each heating resistor R is to be driven is computed on the basis of the temperature of the thermal line head 3 detected by the thermistor, etc., and is divided by the pulse width to determine the number of times that the pulse will be applied, that is, the number by which the strobe signal STB is divided (e.g., 2 to 4). The process then advances to step S13. For example, if the temperature of the thermal line head 3 is high, the number by which the strobe signal STB is divided is reduced. If the temperature of the thermal line head 3 is low, the number by which the strobe signal STB is divided is increased. In the example shown in FIG. 3, the number by which the strobe signal STB (P1 to P6) is set to "4".

The number by which the strobe signal STB is divided with respect to time can be changed according to a printing condition, e.g., the temperature.

In step S13, as strobe signals STB1 to STB6 to be applied to one group divided in step S11, pulses P1 to P6 are output while being phase shifted, as shown in FIG. 3. The process then advances to step S14, in which a determination is made as to whether the number of strobe signals STB output has become equal to the divisor determined in step S12. If the number of strobe signals has not become equal to the divisor, steps S13 and S14 are repeated. If the number of strobe signals has become equal to the divisor, the process advances to step S15.

In step S15, a determination is made as to whether the number of groups to which pulses have been applied has become equal to the number determined in step S11 (the number of groups "4" in the above-described example). If the determined number has not been reached, steps S13 to S15 are repeated. If it is determined that the determined number has been reached, the printing process based on the division printing method is terminated. The above-described printing steps are repeated and the stepping motor 4 is driven with a predetermined timing to feed the heat-sensitive sheet, thereby printing a plurality of lines.

As described above, in the thermal line printer 1 and the method of driving the printer in this embodiment, the division printing method is selected when the number of dots to be printed in one line is comparatively large, while the batch printing method for high-speed printing is selected when the number of dots to be printed in one line is comparatively small, thus reducing variations in power consumption and making it possible to select the optimum printing method according to printing conditions.

Moreover, since the heating resistors R corresponding to dots to be printed are driven by a plurality of pulses divided with respect to time, the temperatures of the heating resistors R are increased generally uniformly, so that the temperature distribution is generally uniform. Therefore it is possible to prevent occurrence of a white gap W (see FIG. 9), i.e., failure to develop the color on the heat-sensitive sheet at certain positions in the case of solid-tone printing, for example, and to obtain a uniform print such as shown in FIG. 7.

The present invention has been described with respect to the concrete embodiment. Needless to say, the present invention is not limited to the described embodiment, and various changes and modifications of the embodiment may be made without departing from the scope of the invention.

For example, the number of blocks into which the heating registers of the thermal line head 3 are separated and the number by which the strobe signal STB is divided can be changed as desired.

According to the present invention, a thermal line printer drive member is provided in which a plurality of heating elements arranged on a line perpendicular to the sheet feed direction are separated into a plurality of blocks, the heating elements in each block are driven separately from those in the other blocks to perform thermal recording on a heat-sensitive sheet, and in which each drive pulse is applied a certain number of times by being divided, thereby making the temperatures of the heating elements generally uniform even though some adjacent pairs of the heating elements are not simultaneously driven. As a result, occurrence of a white gap W, i.e., failure to develop the color on the heat-sensitive sheet at certain positions, can be prevented. Moreover, applying the drive pulse a certain number of times is effective in increasing the temperature of each heating element to a level high enough to sufficiently develop the color on the heat-sensitive sheet.

Also, the comparison step of comparing the number of dots to be printed in one line and the largest number of energization dots for one line, and the printing method selecting step of selecting the division printing method of applying the drive pulse to each heating element in each block a certain number of times by dividing the drive pulse or the batch printing method of simultaneously applying drive pulses to the heating elements in all the blocks may be provided to enable selection of the optimum printing method according to printing conditions.

What is claimed is:

1. A method of driving a thermal line printer having a thermal line head with a plurality of heating elements arranged on a line perpendicular to a sheet feed direction of a heat-sensitive sheet, comprising the steps of:

separating the heating elements into a plurality of blocks; and driving each block in sequential order separately from the other blocks to perform thermal recording on the heat-sensitive sheet, the heating elements of each block being driven in a time division manner by applying a drive pulse to each heating element a plurality of times, the width of the drive pulse and the number of applications of the drive pulse being sufficient to avoid the appearance of a white line on the heat-sensitive sheet between images printed by the respective blocks.

2. A method of driving a thermal line printer having a thermal line head with a plurality of heating elements arranged on a line perpendicular to a sheet feed direction of a heat-sensitive sheet, comprising:

a step of setting a largest number of heating elements that may be energized during printing of a given line;

a comparison step of comparing the number of dots to be printed in one line and the largest number of heating elements that may be energized; and a printing method selecting step of selecting, on the basis of the result of comparison made in the comparison step, one of a division printing method in which the heating elements are separated into a plurality of blocks driven in sequential order and a drive pulse is applied to each heating element in each block a plurality of times, the width of the drive pulse and the number of applications of the drive pulse being sufficient to avoid the appearance of a white line on the heat-sensitive sheet between images printed by the respective blocks, and a batch printing method in which drive pulses are simultaneously applied to the heating elements in more than one of the blocks.

3. A method according to claim 2; further comprising the step of setting a minimum pulse with of the drive pulse applied to the heating elements based on a current and a resistance value of the heating elements.

4. A method according to claim 2; further comprising a step of applying the drive pulse to a group comprised of a plurality of the blocks during the same time period, the number of blocks in the group being determined according to the number of dots to be printed in the given line.

5. A method according to claim 4; wherein the step of applying the drive pulse comprises the step of simultaneously applying groups of pulses to the blocks contained in the group; and further comprising the step of applying drive pulses sequentially to blocks not contained in the group with a phase shift therebetween.

6. A thermal line printer comprising: a thermal head having a plurality of heating elements arranged on a line perpendicular to a sheet feed direction of a heat-sensitive sheet; means for feeding the heat-sensitive sheet relative to the thermal head; drive control means for separating the heating elements into a plurality of blocks, and driving the heating elements in each block separately from those in other blocks to perform thermal recording on the heat-sensitive sheet; and time division application means for applying a drive pulse to each heating element in each block a plurality of times, the width of the drive pulse and the number of applications of the drive pulse being sufficient to avoid the appearance of a white line on the heat-sensitive sheet between images printed by the respective blocks.

7. A thermal line printer comprising: a thermal head having a plurality of heating elements arranged on a line perpendicular to a sheet feed direction of a heat-sensitive sheet; means for feeding the heat-sensitive sheet relative to the thermal head; and drive control means for separating the heating elements into a plurality of blocks, driving the heating elements in each block separately from those in other blocks to perform thermal recording on the heat-sensitive sheet, and having shift application means for applying drive pulses a plurality of times to heating elements in the respective blocks and by phase shifting the pulses with respect to the heating elements in different blocks, the width of the drive pulses and the number of applications of the drive pulses being sufficient to avoid the appearance of a white line on the heat-sensitive sheet between images printed by the respective blocks.

8. A thermal line printer comprising: a thermal head having a plurality of heating elements arranged on a line perpendicular to a sheet feed direction of a heat-sensitive sheet; means for feeding the heat-sensitive sheet relative to the thermal head; drive control means for separating the heating elements into a plurality of blocks, driving the heating elements in each block separately from those in other blocks to perform thermal recording on the heat-sensitive sheet, and having comparison means for comparing the number of dots to be printed in one line and the largest number of heating elements that may be energized during printing of a given line; printing method selecting means for selecting, on the basis of the result of the comparison made by the comparison means, one of a division printing method in which the heating elements are separated into a plurality of blocks driven in sequential order and a drive pulse is applied to the heating elements in each block a plurality of times, the width of the drive pulse and the number of applications of the drive pulse being sufficient to avoid the appearance of a white line on the heat-sensitive sheet between images printed by the respective blocks, and a batch printing method in which drive pulses are simultaneously applied to the heating elements in at least one of the blocks; and time division application means for applying each driving pulse a predetermined number of times in the case where drive pulses are applied by the division printing method.

9. A printer according to claim 6; wherein the drive control means includes number-of-blocks determination means for determining the number of blocks into which the heating elements are separated according to the number of dots to be printed in one line.

10. A method of driving a thermal line printer for performing thermal printing on thermal paper that is fed by a motor with a thermal line head having a plurality of heating elements arranged in a linear manner on a line perpendicular to a paper feeding direction, the method comprising the steps of:

dividing the heating elements of the thermal line head into a plurality of blocks when the amount of data to be printed on a line is greater than a preset maximum value;

performing a division printing operation by driving each block in sequential order, and applying a driving pulse to each of the heating elements in each block a plurality of times, the width of the drive pulse and the number of applications of the drive pulse being sufficient to avoid the appearance of a white line on the heat-sensitive sheet between images printed by the respective blocks; and driving the motor after driving each of the respective blocks to feed the thermal paper.

11. A method according to claim 10; further comprising the steps of setting a largest number of heating elements that may be energized during printing of a given line; comparing the number of dots to be printed in one line and the largest number of heating elements that may be energized; and, based on a result of the comparison, selecting a printing method from one of the division printing method and a batch printing method in which drive pulses are simultaneously applied to the heating elements in more than one of the blocks.

12. A method according to claim 10; further comprising the step of setting a minimum pulse with of the drive pulse applied to the heating elements based on a current and a resistance value of the heating elements.

13. A method according to claim 10; further comprising a step of applying the drive pulse to a group comprised of a plurality of the blocks during the same time period, the number of blocks in the group being determined according to the number of dots to be printed in the given line.

14. A method according to claim 13; wherein the step of applying the drive pulse comprises the step of simultaneously applying drive pulses to the heating elements of each of the blocks contained in the group; and further comprising the step of applying drive pulses sequentially to blocks not contained in the group with a phase shift therebetween.

* * * * *